United States Patent [19]

Bourbon et al.

[11] Patent Number: 4,823,582

[45] Date of Patent: Apr. 25, 1989

[54] DEVICE FOR PLANING A SHEET METAL STRIP UNDER TENSION

[75] Inventors: Jean-Claude Bourbon, Ferrieres-en-Gatinais; Guy Gerard, Beaufort, both of France

[73] Assignees: Fabrique de Fer de Maubeuge, Louvroil; Redex, Ferrieres, both of France

[21] Appl. No.: 166,799

[22] Filed: Mar. 3, 1988

Related U.S. Application Data

[63] Continuation of Ser. No. 901,129, Aug. 28, 1986, abandoned.

[30] Foreign Application Priority Data

Sep. 5, 1985 [FR] France ..... 83 13201

[51] Int. Cl.[4] ..... B21D 1/02

[52] U.S. Cl. ..... 72/164; 72/163; 72/183

[58] Field of Search ..... 72/160, 162–165, 72/183, 205

[56] References Cited

U.S. PATENT DOCUMENTS

| | | | |
|---|---|---|---|
| 2,132,426 | 10/1938 | Maussnest | 72/163 |
| 2,491,782 | 12/1949 | Talbot | 72/165 |
| 3,312,094 | 4/1967 | Birkle | 72/165 |
| 3,834,202 | 9/1974 | Kawaguchi et al. | 72/165 |
| 4,457,149 | 7/1984 | Weinzinger et al. | 72/166 |

FOREIGN PATENT DOCUMENTS

| | | | |
|---|---|---|---|
| 0040568 | 5/1981 | European Pat. Off. . | |
| 1372009 | 8/1963 | France . | |
| 2398805 | 6/1987 | France . | |
| 136516 | 10/1980 | Japan | 72/160 |
| 1206018 | 9/1970 | United Kingdom | 72/164 |

*Primary Examiner*—Daniel C. Crane

*Attorney, Agent, or Firm*—Gerald J. Ferguson, Jr.

[57] ABSTRACT

In a device for planing a sheet metal strip under tension as applicable in particular to rolling mills, the strip is passed between at least two small-diameter working rolls while being subjected to alternate flexural deformations in opposite directions as well as a third working roll located downstream with respect to the first two rolls and supported by a frame which is capable of adjustable pivotal displacement with respect to the first two rolls.

7 Claims, 2 Drawing Sheets

DEVICE FOR PLANING A SHEET METAL STRIP UNDER TENSION

This application is a continuation of Ser. No. 901,129, filed 8/28/86, now abandoned.

BACKGROUND OF THE INVENTION

It is known that sheet metal strips which pass out of a rolling mill exhibit defects of surface planarity which essentially arise from the fact that the fibers do not all have the same length. A planing operation consists in deforming the strip in order to stretch the shortest fibers until they have the same length as the longest fibers. In order to ensure that no residual stress remains within the strip, the entire thickness of the sheet metal has to be subjected to plastic deformation. This plastic deformation is produced by subjecting the strip to a combination of tensile stress and alternate bending stresses.

A large number of existing machines permit the achievement of this result, in the first place by passing the strip through small-diameter rolls and subjecting them to a series of successive bending movements in opposite directions and in the second place by passing them through rolls of increasing diameter in order to eliminate the so-called "tile effect". This effect is observed when a strip has been subjected to a series of bending movements or flexural deformations and the tractive force is then released, whereupon the edges of the strip exhibit a tendency to lift with respect to its central portion.

These known machines are usually of complex design since they make use of a large number of rolls (it is worthy of note in this connection that one working roll is usually associated with two backing rolls). The substantial floor space thus required constitutes a prime factor in the introduction of a continuous production line for processing sheet metal strip such as, for example, a galvanizing line. Furthermore, the adjustment of these machines is a very difficult procedure since it entails a sequence of operations at many different points of the machine when changing either the thickness or the width of the strip to be processed. In consequence, these known machines are integrated in continuous strip-processing lines only when these lines are intended to be employed for uniform and large-scale production. At the present time, however, it is observed that this type of mass production no longer corresponds to current requirements of manufacturers who now find that, for reasons of economic performance, low costs and reduced capital outlay, it is preferable to have installations which offer greater adaptability and thus readily permit the possibility of changing from one type of product to another.

French patent No. FR-1,372,009 discloses a machine for planing under tension in which two planing rolls and one tile-correcting roll cooperate with a backup roll. The structural design of this machine does not permit maximum reduction of floor space occupied in the direction of travel of the metal stock.

The object of the present invention is to propose a planing device of much more compact design which not only satisfies the current requirement of adaptability but can also be readily integrated in existing sheet metal rolling-mill lines of the skin-pass type or of the Sendzimir multiroll type.

SUMMARY OF THE INVENTION

The invention is accordingly directed to a device for planing a sheet metal strip under tension, comprising at least two small-diameter working rolls between which the strip passes while being subjected to successive flexural deformations in opposite directions and a third working roll located downstream in the direction of travel of the strip with respect to the first two rolls and positionally adjustable with respect to said first two rolls.

In accordance with one of the main features of the invention, the aforementioned third working roll is rotatably mounted on a support pivoted about the shaft of the first working roll with respect to the frame which carries the second working roll so as to provide means for adjusting the angle of winding of the metal strip on the second roll and for producing a third flexural deformation of the strip in a direction opposite to its deformation on the second roll with an amplitude which is a function of the relative position of said third roll with respect to said second roll.

In this embodiment, whereas each working roll is carried by a pair of backing rolls in known manner, the aforementioned first and third working rolls are supported by three backing rolls, one backing roll being common to the two working rolls which are rotatably mounted on the pivotal support aforesaid.

The device in accordance with the invention is provided in a general manner with a frame constituted by two relatively spaced vertical side members or uprights. A table constituting the aforementioned support for the first and third working rolls is mounted between said uprights for pivotal motion about an axis which coincides with the axis of the first working roll. A jack is pivotally mounted between the end of the table remote from the point at which it is pivotally mounted on the frame and the base of said frame. A top plate which is located above the table aforesaid and on which the backing rolls of said second working roll are rotatably mounted is coupled to said uprights. The jack aforesaid is provided with actuating means for adjusting and setting the inclination of the table about the axis on which it is pivoted to the frame.

The jack mentioned in the foregoing is preferably a screw jack, the threaded operating rod of which is coupled to said table whilst the translationally fixed nut of the jack is designed in the form of a worm and wheel drive in which the worm constitutes the jack-actuating means mentioned earlier.

Preferably, the top plate aforesaid is carried by the end of an arm which is capable of pivotal displacement between the aforementioned uprights from a first work position in which the plate is located in proximity to said table to a second position in which the plate is located at a distance from said table, said arm being locked on the frame in each of these positions. A jack coupled between the arm and the frame permits operation of the jack between these two positions.

Finally, in the device in accordance with the invention, the diameter of the first working roll aforesaid is smaller than the diameter of the second and third working rolls.

DESCRIPTION OF THE PREFERRED EMBODIMENT

Figure 1:
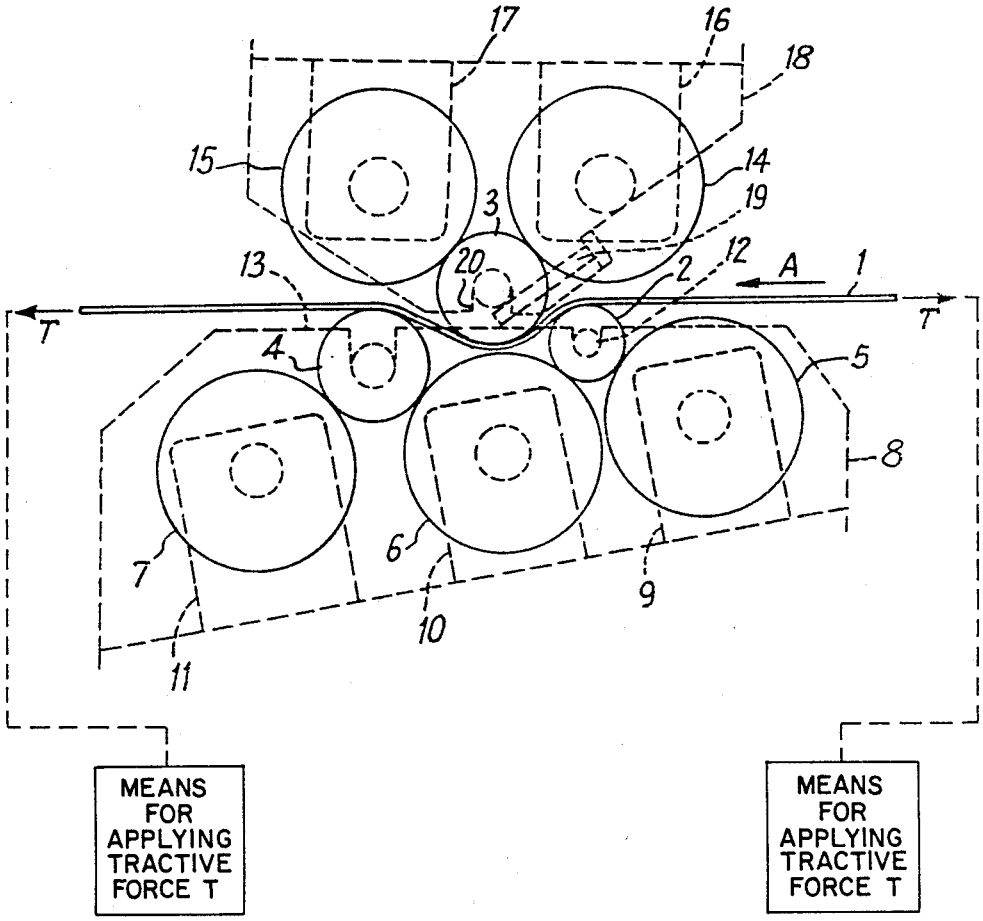
FIG. 1 is a schematic diagram illustrating the principle of operation of the device in accordance with the invention.

Referring first to FIG. 1, there is shown a sheet metal strip 1 which is moving in the direction A under a tractive force T so as to pass between three working rolls 2, 3 and 4. The bottom working rolls 2 and 4 are each supported freely by a pair of backing rolls 5, 6 in the case of the roll 2 and a pair of backing rolls 6, 7 in the case of the working roll 4. The bottom backing rolls 5, 6 and 7 are rotatably supported by bearings 9, 10 and 11 on a lower frame section 8. In accordance with known practice, each backing roll is formed by an axial series of small rollers between which the aforesaid bearings are inserted. By means of this arrangement, the working rolls 2 and 4 are capable of withstanding the high stresses to which they are subjected without deformation. It will be noted that said working rolls 2 and 4 are maintained axially with respect to the frame by means of U-shaped recesses 12 and 13 which are formed in the side walls of said frame and in which the shafts of the working rolls 2 and 4 are rotatably mounted.

Similarly, the working roll 3 is adapted to cooperate with backing rolls 14 and 15 rotatably mounted in bearings 16 and 17 of an upper frame section 18. In order to guard against any danger of disengagement of the roll 3 from the frame section 18 when no metal strip 1 is present, provision has been made for a retaining member 19 which has the function of partially closing the U-shaped recesses 20 of the side walls of the frame section 18 in which the shaft ends of the working roll 3 are rotatably mounted.

In order to explain the operation of the device in accordance with the invention, it will be assumed that the working roll 4 is not present in an initial stage. The relative arrangement of the working rolls 2 and 3 is such that the metal strip which travels in the direction A under tension and passes between these two rolls undergoes a first flexural deformation around the roll 2 followed by a second flexural deformation around the roll 3 in the opposite direction. These alternate and successive bending movements combined with the tractive force T have the effect of stretching all the fibers of the metal strip (or at least the shortest fibers) to a value which attains the length of the longest fibers at the exit point of a rolling process. Since all the fibers are of equal length, the metal strip should have the requisite degree of surface planarity, at least in theory. It is known, however, that winding of a metal strip under tension around a small-diameter roll such as the working roll 2 produces an effect referred-to as a "tile effect" such that the edges of the strip curve upwards to a slight extent with respect to its center.

In order to remedy this defect, it is a known practice to carry out a so-called "anti-tiling" operation which consists in passing the strip between rolls of progressively increasing diameter and preferably in adjusting the value of tension or tractive force to which the strip is subjected.

If it is considered that the device of FIG. 1 is now provided with the working roll 4, the metal strip clearly undergoes a third flexural deformation on the working roll 4. Apart from this flexural deformation, the roll 4 as shown in the figure has had the effect of winding the strip on the working roll 3 over a longer peripheral distance than would otherwise have been the case without said roll 4. It has become apparent that the increase in the aforementioned winding angle and the additional flexural deformation applied to the strip already constituted an anti-tiling effect on condition, however, that this effect can be regulated practically independently of the first planing effect produced on the strip as it passes between the working rolls 2 and 3. It is for this reason that, in accordance with the invention and as will be explained with reference to FIG. 2, the lower frame section 8 is articulated with respect to the upper frame section 18 and pivotally mounted on the shaft of the aforementioned working roll 2. It will thus be understood that, by modifying the angle of slope of the frame section 8 with respect to the frame section 18 about the axis of the roll 2 as indicated by the angle B of FIG. 1, one effect thereby achieved is to modify the angle of winding of the strip on the roll 3 and the other effect thereby achieved is to modify the angle of winding of said strip on the roll 4 without altering the geometrical characteristics of winding of the strip on the roll 2. Planing of a strip passed under tension between these rolls is thus wholly satisfactory as a result of this arrangement, combined with the fact that the rolls 3 and 4 are of larger diameter than the roll 2. By way of example, the roll 2 can have a diameter of 30 mm whilst the rolls 3 and 4 can have a diameter of 40 mm which is preferably the same in both cases. These arrangements facilitate adjustment of the machine which can thus be carried out rapidly as a function of the conditions of surface flatness required and can readily be modified, for example at the time of a change of metal strip and especially a change in thickness of the strip.

Figure 2:
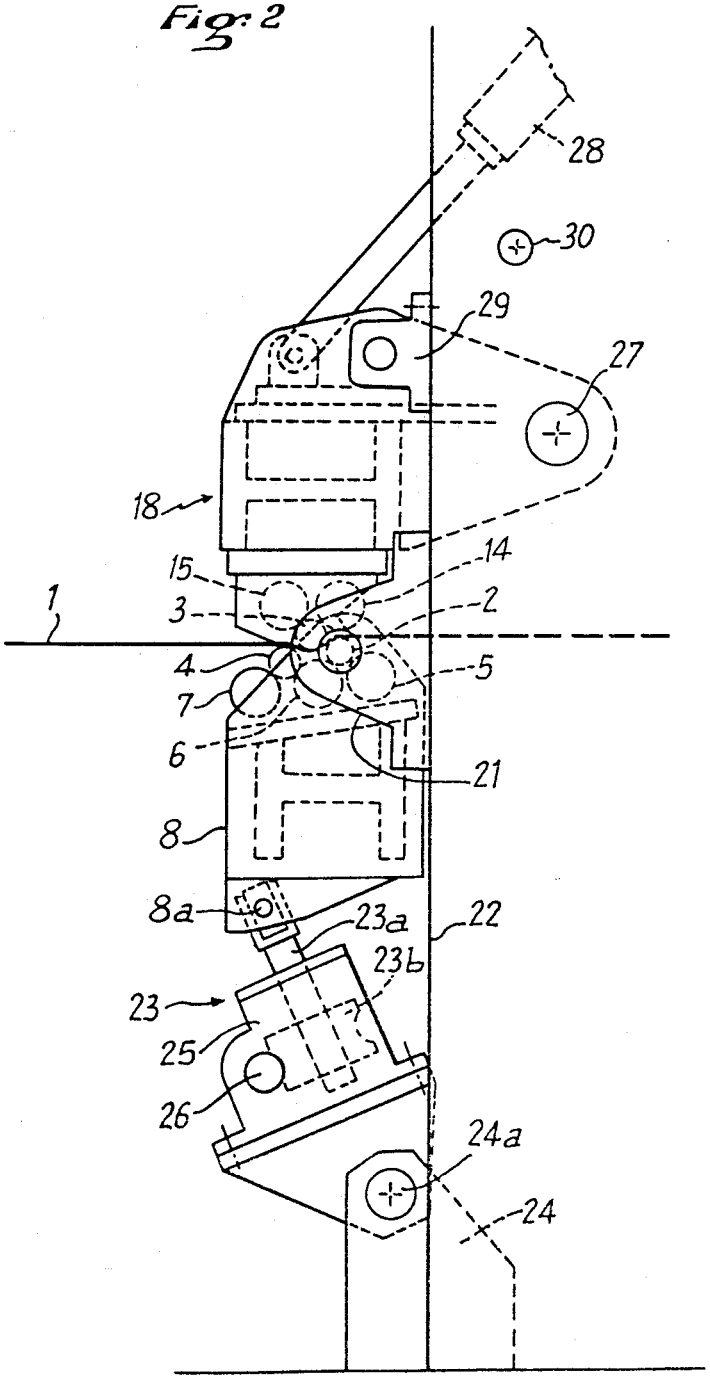
FIG. 2 is a schematic profile view of one embodiment of the device in accordance with the invention.

The schematic profile view of FIG. 2 shows that the aforementioned lower frame section 8 is pivoted about the geometrical axis of the working roll 2 by means of two bearings such as the bearing 21 which are located on each side of said frame section and are in turn attached to a support structure 22 forming part of the general frame of the machine (not shown in the figure). It will be noted that this support structure 22 is designed in the general form of two vertical columns forming two lateral frame uprights to which the constituent elements of the device in accordance with the invention are coupled and between which the metal strip 1 is capable of passing.

In addition, the lower frame section 8 which supports the rolls 2, 4, 5, 6 and 7 is pivotally coupled to a jack 23 by means of a pivot-pin 8*a*, the other end of said jack 23 being pivotally mounted on a bottom frame element 24 by means of a shaft 24*a*. The jack shown diagrammatically in this figure is a screw-type jack, the threaded operating rod 23*a* of which is pivoted to the aforementioned pin 8*a* and the nut 23*b* of which is rigidly fixed translationally in a support 25, said support being in turn pivotally mounted at 24*a* on the bottom frame element 24. The above-mentioned nut 23*b* is designed in the form of a worm and wheel drive in which the worm 26 can be driven in rotation about its axis by means of a drive system (not shown in the drawings). It is apparent from FIG. 2 that actuation of the jack 23 produces a pivotal displacement of the lower frame section 8 about its axis of articulation in the bearing 21.

The upper frame section 18 which supports the rolls 3, 14 and 15 is pivotally mounted on the frame uprights 22 by means of a pivot-pin 27 and can be raised and lowered about said pivot-pin by means of a control jack 28. Two bearings such as the bearing 29 which are rigidly fixed to the frame uprights 22 are adapted to receive locking members which are retractable in a direction at right angles to the plane of FIG. 2 and carried by the upper frame section 18. Similarly, two bearings represented schematically by the bore 30 formed in the frame or support structure 22 can also be fitted with the same locking device. Thus the upper frame section 18 can be displaced by the jack 28 between a first position in which it is locked in the bearing 29, which corresponds to the work position, and a second position in which it is locked within the bore 30, which corresponds to a position of withdrawal. This mode of assembly of the upper frame section 18 is advantageous since it permits the possibility of gaining free access to the working and backing rolls of the lower frame section 8 and also allows accidental overthicknesses of metal strip such as welded butt joints to pass through the machine.

Whereas in the example shown in FIG. 2 the relative position of the rolls 2 and 3 is determined once and for all by the position of the upper frame section 18 in which this latter is locked in the bearing 29, the invention also extends to a device provided with means for fine adjustment of the relative positions of the rollers 2 and 3. This adjustment can be carried out for example by a device for modifying the point of coupling of the locking-pins which cooperate with the bearings 29 to the upper frame section 18.

The arrangements in accordance with the invention permit the construction of a machine which is extremely compact in the direction of travel of metal stock and can consequently be readily integrated in a rolling-mill of the skin-pass type or in multiroll mills of the Sendzimir type.

The invention finds an advantageous application in the metallurgical industry, particularly in the field of process metallurgy and rolling-mill practice.

What is claimed is:

1. A device for planning a sheet metal strip under tension supplied from a source of metal strip that has been produced by milling, comprising only three working rolls comprising at least two small-diameter first and second working rolls between which the strip passes while being subjected to successive flexural deformation in opposite directions, and a third working roll located downstream in the direction of travel of the strip with respect to the first two rolls and positionally adjustable with respect to said first two rolls and at least two tensioning means respectively disposed upstream of said first two rolls and downstream of said third working roll for effecting said tension of the strip with the direction of feed being from said first working roll to said third working roll of said planning device, wherein the third working roll aforesaid is rotatably mounted on a support pivoted about a shaft of the first working roll with respect to the frame which carries the second working roll so as to provide means for adjusting the angle of winding of the metal strip on the second roll and for producing a third flexural deformation of the strip in a direction opposite to its deformation on the second roll with an amplitude which is a function of the relative position of said third roll with respect to said second roll.

2. A device according to claim 1, wherein each working roll is carried by a pair of backing rolls and wherein the first and third working rolls aforesaid are supported by three backing rolls, one backing roll being common to the two working rolls which are rotatably mounted on the pivotal support aforesaid.

3. A device according to claim 1, wherein said device comprises:

a frame constituted by two relatively spaced uprights;

a table pivoted between said uprights about an axis which coincides with the axis of the first working roll, said table being intended to constitute the aforementioned support for the three backing rolls on which the first and third working rolls are applied;

a jack pivotally mounted between the end of the table remote from the point at which it is pivotally mounted on the frame and the base of said frame;

a top plate which is located above said table and on which the backing rolls of said second working roll are rotatably mounted, said plate being coupled to the uprights aforesaid;

means for actuating said jack in order to adjust and set the inclination of the table about the axis on which it is pivoted to the frame.

4. A device according to claim 3, wherein the jack aforesaid is a screw jack having a threaded operating rod which is coupled beneath said table whilst the translationally fixed nut of the jack is designed in the form of a worm and wheel drive in which the worm constitutes the jack-actuating means aforesaid.

5. A device according to claim 3, wherein the top plate aforesaid is constituted by the end of a frame section mounted for pivotal displacement between said uprights between a first work position in which the plate is located in proximity to the table and a second position in which the plate is located at a distance from said table, said frame section in the form of a pivotal arm being locked on the frame in each of said positions.

6. A device according to claim 5, wherein a jack is coupled between said frame section and the frame.

7. A device according to claim 1, wherein the diameter of the first working roll aforesaid is smaller than the diameters of the second and third working rolls.

* * * * *